US010297374B1

(12) United States Patent
Oh et al.

(10) Patent No.: US 10,297,374 B1
(45) Date of Patent: May 21, 2019

(54) METAL OXIDE VARISTOR HAVING AN OVERCURRENT PROTECTION FUNCTION

(71) Applicant: SAMHWA CAPACITOR CO., LTD., Yongin-si (KR)

(72) Inventors: Young Joo Oh, Seoul (KR); Jung Rag Yoon, Yongin-si (KR); Kun Hwa Lee, Seongnam-si (KR); Chang Kil Shon, Yongin-si (KR)

(73) Assignee: SAMHWA CAPACITOR CO., LTD., Yongin-si (KR)

( * ) Notice: Subject to any disclaimer, the term of this patent is extended or adjusted under 35 U.S.C. 154(b) by 0 days.

(21) Appl. No.: 16/189,272

(22) Filed: Nov. 13, 2018

(30) Foreign Application Priority Data

Dec. 28, 2017 (KR) ..... 10-2017-0182303

(51) Int. Cl.
*H01C 7/12* (2006.01)
*H01C 17/065* (2006.01)

(52) U.S. Cl.
CPC ..... *H01C 7/12* (2013.01); *H01C 17/06533* (2013.01)

(58) Field of Classification Search
CPC ..... H01C 7/12; H01C 17/06533
See application file for complete search history.

(56) References Cited

U.S. PATENT DOCUMENTS 5,808,850 A * 9/1998 Carpenter, Jr. ..... H01C 7/12 361/111
5,936,824 A * 8/1999 Carpenter, Jr. ..... H01C 7/112 361/117
7,477,503 B2 * 1/2009 Aszmus ..... H01C 7/126 361/103
7,684,166 B2 * 3/2010 Donati ..... H01C 7/126 361/103
8,378,778 B2 * 2/2013 Duval ..... H01C 7/126 338/13
2003/0155663 A1 * 8/2003 Yamamoto ..... H01L 21/563 257/788
2003/0183944 A1 * 10/2003 Taniguchi ..... H01L 25/0657 257/777
2006/0160347 A1 * 7/2006 Nakayama ..... H01L 21/4853 438/612

(Continued)

FOREIGN PATENT DOCUMENTS

KR 101458720 11/2014

*Primary Examiner* — Kyung S Lee
(74) *Attorney, Agent, or Firm* — Cantor Colburn LLP

(57) ABSTRACT

Provided is a metal oxide varistor having an overcurrent protection function. The metal oxide varistor includes a metal oxide varistor body, a first electrode layer, a second electrode layer coated, an anistropic conductive paste (ACP) attached to a surface of the first electrode layer on one side of the first direction, a fuse plate bonded to the ACP and electrically conductive to the first electrode layer, a first copper-plated wire having one side of a second direction orthogonal to the first direction connected to the fuse plate, a second copper-plated wire having one side of the second direction bonded to the surface of the second electrode layer on the other side of the first direction, and an insulated coating member configured to surround the first copper-plated wire and the second copper-plated wire on one side of the second direction, the metal oxide varistor body and the fuse plate.

11 Claims, 4 Drawing Sheets

(56) References Cited

U.S. PATENT DOCUMENTS

| | | | | |
|---|---|---|---|---|
| 2012/0006583 | A1* | 1/2012 | Ishihara | H01C 7/1006 174/254 |
| 2012/0261171 | A1* | 10/2012 | Yamada | C09J 7/10 174/255 |
| 2015/0209914 | A1* | 7/2015 | Ishigami | H01L 33/62 257/99 |
| 2016/0370210 | A1* | 12/2016 | Kapusta | G01K 1/14 |

* cited by examiner

METAL OXIDE VARISTOR HAVING AN OVERCURRENT PROTECTION FUNCTION

BACKGROUND OF THE INVENTION

1. Technical Field

The present invention relates to a metal oxide varistor (MOV) having an overcurrent protection function and, more particularly, to an MOV, which has an overcurrent protection function and can be easily fabricated by bonding a varistor body and a fuse having a melting point of 220 to 300° C. using an anistropic conductive paste (ACP) having a low melting point of 130 to 200° C.

2. Description of the Related Art

A metal oxide varistor (MOV) includes a thermal fuse for protection against an overcurrent attributable to a surge voltage. A technique related to an MOV including a thermal fuse is disclosed in Korean Patent Application Publication No. 10-1458720 (Patent Document 1).

Patent Document 1 relates to an MOV device having a thermally fused fuse. The MOV includes an MOV body, an insulating end plate, a first terminal, a second terminal, a third terminal, a fuse and an insulated coating.

The MOV body has the insulated coating surrounding the MOV. The insulating end plate is coupled to one end of the MOV body. The first terminal is extended from the upper side of the MOV body to the outside through the insulating end plate, and has an end bent portion near an end connected to the fuse. The second terminal and the third terminal are connected to the MOV within the insulated coating. The fuse connects the first terminal to the second terminal or the third terminal at the top of the MOV body. Accordingly, the fuse is fused by heat generated due to an overcurrent, thus performing a protection function against a surge voltage by insulating the first terminal from the MOV.

An MOV having a fuse fused for protection against an overcurrent attributable to a surge voltage, such as Patent Document 1, has a problem in that fabrication is difficult because a task of connecting the fuse to the MOV body is difficult due to a low melting point of the fuse when the MOV is connected to the MOV body by bonding. Furthermore, in the conventional MOV having a fuse fused for protection against an overcurrent, thermal treatment of a high temperature of 550 to 800° C. is performed because glass frit is used in a gold (Au) paste when an electrode to which a copper-plated wire, such as the first terminal, is connected is formed. Accordingly, there is a problem in that reliability of a product may be deteriorated because a leakage current may be generated due to the volatilization of $Bi_2O_3$ if $Bi_2O_3$ of the materials of the MOV is included in the MOV body.

PRIOR ART DOCUMENT

Patent Document (Patent Document 1) Korean Patent Application Publication No. 10-1458720

SUMMARY OF THE INVENTION

Accordingly, the present invention has been made keeping in mind the above problems occurring in the prior art, and an object of the present invention is to provide a metal oxide varistor (MOV), which has an overcurrent protection function and can be easily fabricated by bonding a varistor body and a fuse having a melting point of 220 to 300° C. using an anistropic conductive paste (ACP) having a low melting point of 130 to 200° C.

Another object of the present invention is to provide an MOV having an overcurrent protection function, which can be subjected to thermal treatment using a low thermal treatment temperature because only metal nanopowder is used without using glass frit in a metal paste used when an electrode to which a copper-plated wire is connected is formed.

Yet another object of the present invention is to provide an MOV having an overcurrent protection function, which can prevent reliability of a product from being deteriorated by preventing a leakage current generated due to the volatilization of $Bi_2O_3$ of the materials of the MOV by lowering a thermal treatment temperature using only metal nanopowder in a metal paste used when an electrode to which a copper-plated wire is connected is formed.

In an aspect of the present invention, a metal oxide varistor having an overcurrent protection function includes a metal oxide varistor body, a first electrode layer coated on a surface of the metal oxide varistor body on one side of a first direction, a second electrode layer coated on a surface of the metal oxide varistor body on the other side of the first direction, an anistropic conductive paste (ACP) attached to a surface of the first electrode layer on one side of the first direction, a fuse plate bonded to the ACP and electrically conductive to the first electrode layer, a first copper-plated wire having one side of a second direction orthogonal to the first direction connected to the fuse plate, a second copper-plated wire having one side of the second direction bonded to the surface of the second electrode layer on the other side of the first direction, and an insulated coating member configured to surround the first copper-plated wire and the second copper-plated wire on one side of the second direction, the metal oxide varistor body and the fuse plate. The first direction indicates the thickness direction of the metal oxide varistor body, the first electrode layer, the second electrode layer and the fuse plate. The second direction indicates the length direction of each of the metal oxide varistor body, the first electrode layer, the second electrode layer, the fuse plate, the first copper-plated wire and the second copper-plated wire.

DETAILED DESCRIPTION

Hereinafter, a metal oxide varistor (MOV) having an overcurrent protection function according to embodiments of the present invention are described in detail with reference to the accompanying drawings.

Figure 1:
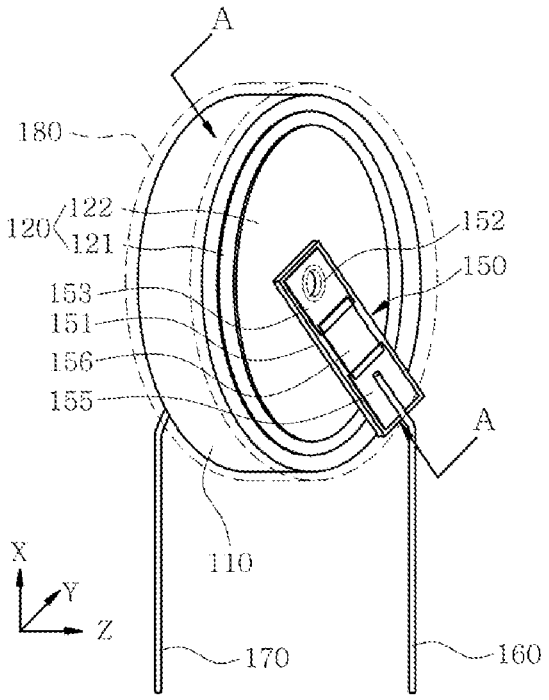
FIG. 1 is a perspective view of an MOV having an overcurrent protection function according to an embodiment of the present invention.
Figure 2:
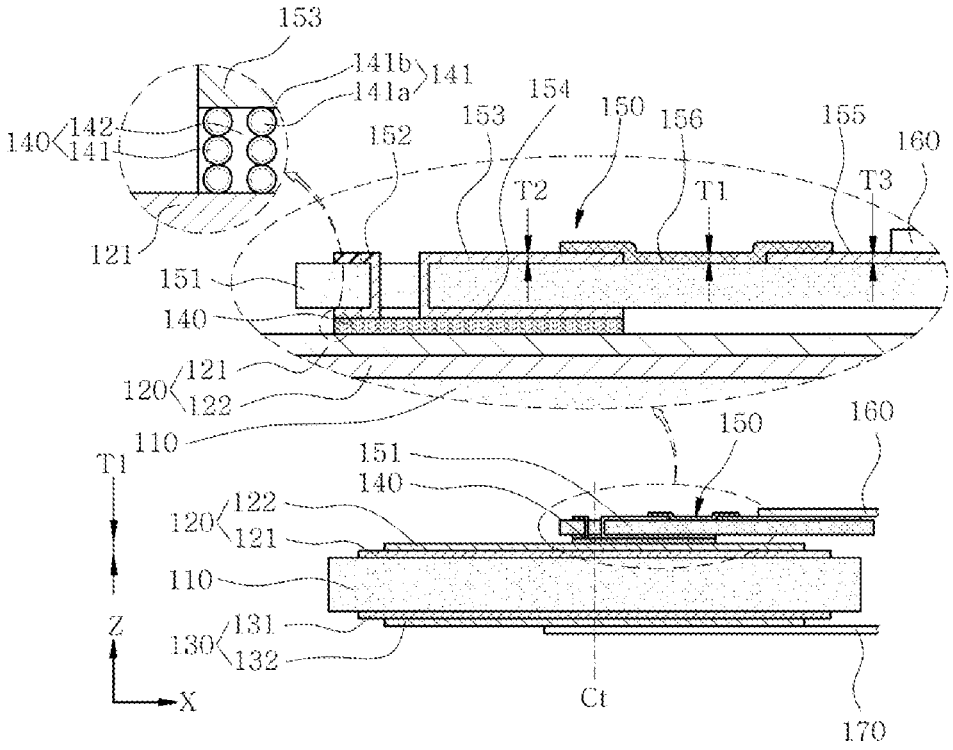
FIG. 2 is a cross-sectional view of the MOV having an overcurrent protection function, which is taken along line A-A in FIG. 1.

As shown in FIGS. 1 and 2, an MOV having an overcurrent protection function according to an embodiment of the present invention includes an MOV body 110, a first electrode layer 120, a second electrode layer 130, an anistropic conductive paste (ACP) 140, a fuse plate 150, a first copper-plated wire 160, a second copper-plated wire 170 and an insulated coating member 180.

The MOV body 110 is configured in a cylindrical disk type. The first electrode layer 120 is coated on a surface of the MOV body 110 on one side of a first direction (Z). The second electrode layer 130 is coated on a surface of the MOV body 110 on the other side of the first direction (Z). The ACP 140 is bonded to a surface of the first electrode layer 120 on one side of the first direction (Z). The fuse plate 150 is bonded to the ACP 140 and connected to the first electrode layer 120 in such a way as to be electrically conductive to the first electrode layer 120. The first copper-plated wire 160 is connected to the fuse plate 150 on one side of a second direction (X) orthogonal to the first direction (Z). The second copper-plated wire 170 is bonded to a surface of the second electrode layer 130 on the other side of the first direction (Z) on one side of the second direction (X). The insulated coating member 180 is configured to surround the first copper-plated wire 160 and the second copper-plated wire 170 on one side of the second direction (X), the MOV body 110, and the fuse plate 150. In this case, the first direction (Z) indicates the thickness direction of the MOV body 110, the first electrode layer 120, the second electrode layer 130 and the fuse plate 150. The second direction (X) indicates the length direction of each of the MOV body 110, the first electrode layer 120, the second electrode layer 130, the fuse plate 150, the first copper-plated wire 160, and the second copper-plated wire 170.

The configuration of the MOV having an overcurrent protection function according to an embodiment of the present invention is described in detail below.

As shown in FIGS. 1 and 2, the MOV body 110 is configured in a cylindrical disk type by mixing ZnO, $Bi_2O_3$, $Pr_6O_{ii}$, CoO, NiO and MnO. The MOV body 110 may be configured in a cylindrical disk type by mixing ZnO, $Pr_6O_{11}$, CoO, NiO and MnO. If the MOV body is configured in a cylindrical disk type, there is a high probability that a defect may occur along the circumference of the edge of the MOV body 110 due to forming pressure irregularity. A known technique is applied to a defect that may occur when the cylindrical disk type is formed and a mixing ratio of ZnO, $Bi_2O_3$, $Pr_6O_{11}$, CoO, NiO and MnO, and thus a detailed description thereof is omitted.

As shown in FIGS. 1 and 2, the first electrode layer 120 and the second electrode layer 130 include first metal coating layers 121 and 131 and second metal coating layers 122 and 132, respectively.

The first metal coating layers 121 and 131 are respectively coated on surfaces of the MOV body 110 one side or the other side of the first direction (Z) on the basis of the center Ct of the MOV body 110. For example, the first metal coating layer 121 is coated on a surface of the MOV body 110 on one side of the first direction (Z) on the basis of the center Ct of the MOV body 110. The first metal coating layer 131 is coated on a surface of the MOV body 110 on the other side of the first direction (Z) on the basis of the center Ct (shown in FIGS. 2 and 3) of the MOV body 110. Each of the first metal coating layers 121 and 131 is coated smaller than the surface area of the MOV body 110 one side or the other side of the first direction (Z) so that the first metal coating layer is positioned within the MOV body 110 on the basis of the center Ct of the MOV body 110.

The second metal coating layers 122 and 132 are respectively coated on surfaces of the first metal coating layers 121 and 131 on one side or the other side of the first direction (Z) on the basis of the center Ct of the first metal coating layers 121 and 131. In this case, the second metal coating layer 122 is coated on the surface of the first metal coating layer 121 on one side of the first direction (Z) on the basis of the center Ct of the first metal coating layer 121. The second metal coating layer 132 is coated on the surface of the first metal coating layer 131 on the other side of the first direction (Z) on the basis of the center Ct of the first metal coating layer 131. The second metal coating layers 122 and 132 are coated smaller than the surface areas of the first metal coating layers 121 and 131 on one side or the other side of the first direction (Z) on the basis of the center Ct of the first metal coating layers 121 and 131 so that the second metal coating layers 122 and 132 are positioned within the first metal coating layers 121 and 131, respectively.

The first metal coating layer 121, 131 or the second metal coating layer 122, 132 formed on the surface of the MOV body 110 one side or the other side of the first direction (Z) is formed by printing a metal paste in a disk type and then performing thermal treatment at a temperature of 180 to 250° C. The metal paste is formed by mixing metal nanopowder 90 to 95 wt % and an organic solvent 5 to 10 wt %. The metal nanopowder is made of Ag and may have an average grain diameter of 0.5 to 20 nm. In this case, ethylene carbonate (EC) or dimethyl carbonate (DMC) is used as the organic solvent. Accordingly, a thermal treatment temperature can be lowered because only the metal nanopowder and the organic solvent are used when the first metal coating layers 121 and 131 or the second metal coating layers 122 and 132 to which the first copper-plated wire 160 or the second copper-plated wire 170 formed in the MOV body 110 is connected are formed.

The MOV having an overcurrent protection function according to an embodiment of the present invention can prevent $Bi_2O_3$ from being volatilized due to a thermal treatment temperature because thermal treatment is performed by dropping the thermal treatment temperature to 180 to 250° C. when the first metal coating layers 121 and 131 or the second metal coating layers 122 and 132 are formed. Accordingly, an increase in the leakage current of the MOV body 110 which may be generated due to the volatilization of $Bi_2O_3$ can be prevented because the volatilization of $Bi_2O_3$ is prevented, thereby being capable of preventing the deterioration of product reliability.

Figure 5:
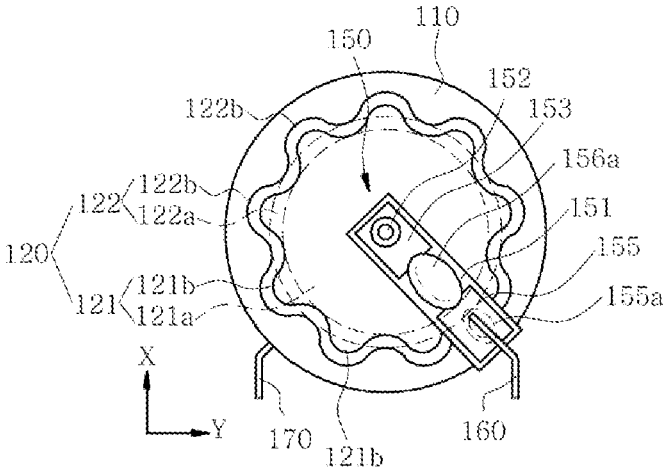
FIG. 5 is a plan view of the MOV having an overcurrent protection function according to another embodiment of a first electrode layer and second electrode layer shown in FIG. 3.

Another embodiment of the first metal coating layers 121 and 131 or the second metal coating layers 122 and 132 is shown in FIG. 5. The first metal coating layer 131 and the second metal coating layer 132 formed on the surface of the MOV body 110 on the other side of the first direction (Z) are formed to be identical with the first metal coating layer 121 and the second metal coating layer 122 formed on the surface of the MOV body 110 on one side of the first direction (Z). Accordingly, a description of another embodiment of the shapes of the first metal coating layer 131 and the second metal coating layer 132 formed on the surface of the MOV body 110 on the other side of the first direction (Z) is omitted. As shown in FIG. 5, the first metal coating layer 121 and the second metal coating layer 122 include disk type metal plates 121*a* and 122*a* and a plurality of protruded metal plates 121*b* and 122*b*, respectively.

The disk type metal plate 121*a*, 122*a* is coated on a surface of the MOV body 110 or the first metal coating layer 121, 131 on one side or the other side of the first direction (Z) on the basis of the center Ct of the MOV body 110 or the first metal coating layer 121, 131. The plurality of protruded metal plates 121*b*, 122*b* is extended from the edge of the disk type metal plate 121*a*, 122*a*. The ends of the plurality of protruded metal plates 121*b*, 122*b* on one side of the second direction (X) are connected to the edge of the disk type metal plate 121*a*, 122*a*. The ends of the plurality of protruded metal plates 121*b*, 122*b* on the other side of the second direction (X) are coated so that they are positioned within the surface of the MOV body 110 or the first metal coating layer 121, 131 on one side or the other side of the first direction (Z). Each of the ends of the plurality of protruded metal plates 121*b*, 122*b* on the other side of the second direction (X) is configured in a curve. As described above, the first metal coating layers 121, 131 or the second metal coating layer 122, 132 includes the disk type metal plate 121*a*, 122*a* and the plurality of protruded metal plates 121*b*, 122*b*. Accordingly, when heat is generated due to a defect which may occur along the circumference of the edge of the MOV body 110 because the MOV body 110 is configured in a cylindrical disk type, the heat can be easily delivered to the fuse plate 150 through the first metal coating layer 121, 131 or the second metal coating layer 122, 132. As a result, reliability of product protection according to the occurrence of heat can be improved.

As shown in FIG. 2, the ACP 140 includes multiple coated metal particles 141 and a binder 142.

Each of the multiple coated metal particles 141 includes a metal particle 141*a* and a metal coating layer 141*b*. The metal particle 141*a* is configured in a globular shape. The metal coating layer 141*b* is coated to surround a surface of the metal particle 141*a* configured in a globular shape and thus connects the first electrode layer 120 and the fuse plate 150 so that they are electrically conductive. In this case, the metal particle 141*a* is made of Bi—Sn series, that is, a mixture of Bi and Sn. The metal coating layer 141*b* is made of Ag or Au. The multiple coated metal particles 141, that is, the ACP 140, may have a low melting point of 130 to 200° C. In this case, a method of forming the metal particle 141*a* by mixing Bi and Sn so that the multiple coated metal particles 141 melt at a low melting point of 130 to 200° C. and the metal coating layer 141*b* is formed using Ag or Au is a known technology, and thus a description thereof is omitted. The binder 142 is mixed with the multiple coated metal particles 141. A known binder used for the ACP 140 is used as the binder 142, and thus a description of the binder is omitted. In the ACP 140, a viscosity regulator is mixed in addition to the multiple coated metal particles 141 and the binder 142 so that the viscosity of the ACP 140 is several tens to several hundreds of centi Poise (cps). In this case, alcohol is used as the viscosity regulator. A method of mixing the multiple coated metal particles 141, the binder 142 and the viscosity regulator used to fabricate the ACP 140 is a known method, and thus a description thereof is omitted.

The ACP 140 including the multiple coated metal particles 141 and the binder 142 as described above easily connects the first electrode layer 120, coated on the MOV body 110, and the fuse plate 150 at a low melting point of 130 to 200° C. so that the first electrode layer 120 and the fuse plate 150 are electrically conductive. Accordingly, the MOV having an overcurrent protection function according to an embodiment of the present invention can improve product productivity because the MOV body 110, that is, the varistor body, and the fuse plate 150 can be easily bonded. The ACP 140 can bond the fuse plate 150 to the first electrode layer 120 at a low temperature so that they are electrically conductive because the fuse plate 150 is bonded to the first electrode layer 120 by thermal compression. Accordingly, the first electrode layer 120 can be prevented from being molten and damaged by heat when the fuse plate 150 is bonded to the first electrode layer 120.

As shown in FIGS. 1 and 2, the fuse plate 150 includes an insulating substrate 151, a via hole pattern 152, a pair of first router patterns 153 and 154, a second router pattern 155 and a fuse pattern 156.

The insulating substrate 151 prevents the first electrode layer 120 and the fuse plate 150 or the first copper-plated wire 160 from being electrically connected. The insulating substrate 151 is made of ceramics and positioned over a surface of the MOV body 110 on one side of the first direction (Z) so that it is horizontal to the first copper-plated wire 160 on one side of the second direction (X). In this case, the insulating substrate 151 is inclined at an angle θ1 with respect to the second direction (X). For example, in the state in which a portion on which the first copper-plated wire 160 or the second copper-plated wire 170 is to be mounted, that is, the first copper-plated wire 160 or the second copper-plated wire 170 on the other side of the second direction (X), and the second direction (X) are parallel, the first copper-plated wire 160 on one side of the second direction (X) is inclined at an angle θ2 in the MOV body 110 and the insulating substrate 151 is inclined at the angle θ2. Accordingly, the insulating substrate 151 and the first copper-plated wire 160 on one side of the second direction (X) are disposed horizontally.

The via hole pattern 152 is formed in the insulating substrate 151 on one side of the second direction (X). The via hole pattern 152 is formed by forming a through hole through which the insulating substrate 151 is penetrated in the first direction (Z) and then coating the inner circumference surface of the through hole with metal so that the surfaces of the insulating substrate 151 on one side and the other side of the first direction (Z) are electrically connected.

The pair of first router patterns 153 and 154 is formed on the surfaces of the insulating substrate 151 on one side and the other side of the first direction (Z), respectively, so that the insulating substrate 151 on one side of the second direction (X) is brought into contact and connected with the via hole pattern 152. The first router pattern 154 that belongs to the pair of first router patterns 153 and 154 and that is formed on a surface of the insulating substrate 151 on the other side of the first direction (Z) is bonded to the first electrode layer 120 coated on the surface of the MOV body 110 on one side of the first direction (Z) by the ACP 140. That is, the insulating substrate 151 is positioned and bonded to the surface of the MOV body 110 on one side of the first direction (Z) by bonding the first router pattern 154 formed on the surface of the insulating substrate 151 on the other side of the first direction (Z) to the first electrode layer 120 using the ACP 140.

The second router pattern 155 is formed on a surface of the insulating substrate 151 on one side of the first direction (Z) in such a way as to be isolated from the first router pattern 153 formed on the surface of the insulating substrate 151 on one side of the first direction (Z) in the insulating substrate 151 on the other side of the second direction (X). The first copper-plated wire 160 is connected to a surface of the second router pattern 155 on one side of the first direction (Z) by a solder ball 155*a*. The solder ball 155*a* is formed by mixing two or more of Ag, Cu and Sn so that it melts at a temperature of 220 to 300° C. That is, the solder ball 155*a* is formed by mixing two or more of Ag, Cu and Sn so that it melts at a temperature of 220 to 300° C.

Figure 3:
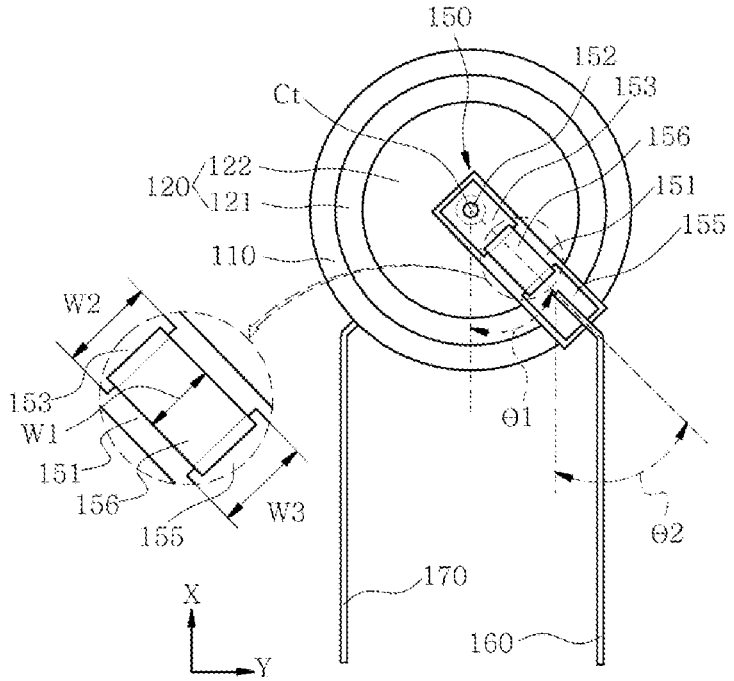
FIG. 3 is a plan view of the MOV having an overcurrent protection function of FIG. 1.

The fuse patterns 156 are formed on the surface of the insulating substrate 151 on one side of the first direction (Z) so that the first router patterns 154 and the second router pattern 155 are electrically conductive. As shown in FIG. 3, the width length W1 of the fuse pattern 156 is smaller than the width length W2 of the first router pattern 153, 154 and the width length W3 of the second router pattern 155 so that the fuse pattern 156 melts earlier than the first router pattern 153, 154 or the second router pattern 155 under the same temperature condition, thereby improving reliability of a fuse operation. Furthermore, as shown in FIG. 2, t the thickness T1 of the fuse pattern 156 is smaller than the thickness T2 of the first router pattern 153, 154 and the thickness T3 of the second router pattern 155 so that the fuse pattern 156 melts earlier than the first router pattern 153, 154 or the second router pattern 155 under the same temperature condition, thereby improving reliability of a fuse operation. The width length W2 of the first router pattern 153, 154 and the width length W3 of the second router pattern 155 or the thickness T2 of the first router pattern 153, 154 and the thickness T3 of the second router pattern 155 are identical.

Figure 4:
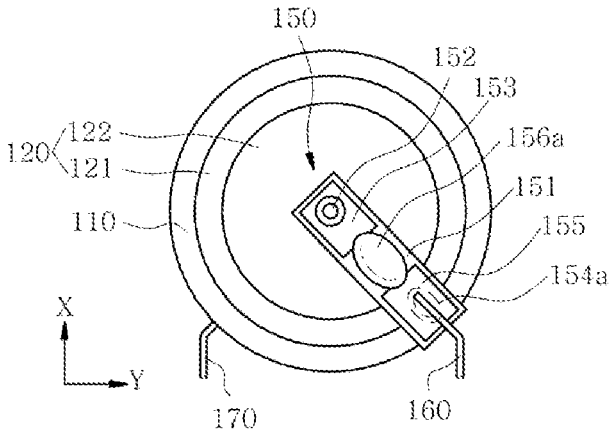
FIG. 4 is a plan view of the MOV having an overcurrent protection function according to another embodiment of a fuse plate show in FIG. 3.

The fuse plate 150 is made of the same material as the fuse pattern 156 so that the via hole pattern 152, the pair of first router patterns 153 and 154, and the second router pattern 154 have a lower melting temperature than the fuse pattern 156 in order to improve reliability of a fuse operation of the fuse pattern 156. For example, if the via hole pattern 152, the pair of first router patterns 153 and 154 and the second router pattern 154 of the via hole pattern 152, the pair of first router patterns 153 and 154, the second router pattern 155 and the fuse pattern 156 are made of Cu or Ag, the fuse pattern 156 is formed by mixing Ag, Cu and Sn. Accordingly, the fuse pattern 156 melts at a temperature of 220 to 300° C. so that the first router pattern 153 and the second router pattern 154 are open. The fuse pattern 156 may have a square router pattern as shown in FIG. 3 or may have the shape of a solder ball 156 shown in FIG. 4 or 5.

As described above, the fuse plate 150 is formed by mixing two or more of Ag, Cu and Sn so that the solder ball 155*a* and the fuse pattern 156 melt at a temperature of 220 to 300° C. After the first copper-plated wire 160 is previously connected to the fuse plate 150, the fuse plate 150 is connected to the first electrode layer 120 formed in the MOV body 110 using the ACP 140 that melts at a low melting point of 130 to 200° C. Accordingly, the MOV having an overcurrent protection function according to an embodiment of the present invention can be easily fabricated. In this case, a method of mixing two or more of Ag, Cu and Sn so that the solder ball 155*a* and the fuse pattern 156 melt at a temperature of 220 to 300° C. is a known technique, and thus a description thereof is omitted.

The first copper-plated wire 160 and the second copper-plated wire 170 are inclined and disposed in the first electrode layer 120 on one side of the second direction (X) and are connected to the fuse plate 150 or the second electrode layer 130. The insulated coating member 180 is made of an epoxy material.

As described above, the MOV having an overcurrent protection function according to an embodiment of the present invention can be easily fabricated by bonding the varistor body, that is, the MOV body 110, and the fuse plate 150 using the ACP 140, and can also lower a thermal treatment temperature using only metal nanopowder without using glass frit in a metal paste used to fabricate the first electrode layer 120 or the second electrode layer 130. Accordingly, a leakage current can be prevented from increasing because $Bi_2O_3$ of the materials of the MOV body 110 is prevented from being volatilized due to a thermal treatment temperature, thereby being capable of preventing product reliability from being deteriorated.

As described above, the metal oxide varistor (MOV) having an overcurrent protection function according to an embodiment of the present invention has an advantage in that it can be easily fabricated by bonding the varistor body and the fuse having a melting point of 220 to 300° C. using the anistropic conductive paste (ACP) having a low melting point of 130 to 200° C. Furthermore, the MOV has an advantage in that thermal treatment can be performed using a low thermal treatment temperature because only metal nanopowder is used without using glass frit in the metal paste used when the electrode to which the copper-plated wire is connected is formed. Furthermore, the MOV has an advantage in that it can prevent reliability of a product from being deteriorated by preventing a leakage current generated due to the volatilization of $Bi_2O_3$ of the materials of the MOV because a thermal treatment temperature is lowered using only metal nanopowder in the metal paste used to form the electrode to which the copper-plated wire is connected.

The MOV having an overcurrent protection function according to an embodiment of the present invention may be applied to the industrial field for fabricating metal oxide varistors.

What is claimed is:

1. A metal oxide varistor having an overcurrent protection function, comprising:

a metal oxide varistor body;

a first electrode layer coated on a surface of the metal oxide varistor body on one side of a first direction;

a second electrode layer coated on a surface of the metal oxide varistor body on the other side of the first direction;

an anistropic conductive paste (ACP) attached to a surface of the first electrode layer on the one side of the first direction;

a fuse plate bonded to the ACP and electrically conductive to the first electrode layer;

a first copper-plated wire having one side of a second direction orthogonal to the first direction connected to the fuse plate;

a second copper-plated wire having the one side of the second direction bonded to the surface of the second electrode layer on the other side of the first direction; and an insulated coating member configured to surround the first copper-plated wire and the second copper-plated wire on the one side of the second direction, the metal oxide varistor body and the fuse plate, wherein the first direction indicates a thickness direction of the metal oxide varistor body, the first electrode layer, the second electrode layer and the fuse plate, and the second direction indicates a length direction of each of the metal oxide varistor body, the first electrode layer, the second electrode layer, the fuse plate, the first copper-plated wire and the second copper-plated wire.

2. The metal oxide varistor of claim 1, wherein the metal oxide varistor body is formed in a cylindrical disk type by mixing ZnO, $Bi_2O_3$, $Pr_6O_{11}$, CoO, NiO and MnO.

3. The metal oxide varistor of claim 1, wherein each of the first electrode layer and the second electrode layer comprises:

a first metal coating layer coated on the surface of the metal oxide varistor body on the one side or the other side of the first direction based on a center of the metal oxide varistor body; and a second metal coating layer coated on a surface of the first metal coating layer on one side or the other side of the first direction based on a center of the first metal coating layer, wherein the first metal coating layer is coated smaller than a surface area of the metal oxide varistor body on the one side or the other side of the first direction based on the center of the metal oxide varistor body, and the second metal coating layer is coated smaller than a surface area of the first metal coating layer on the one side or the other side of the first direction based on the center of the first metal coating layer.

4. The metal oxide varistor of claim 3, wherein:

each of the first metal coating layer and the second metal coating layer is formed by printing a metal paste in a disk shape and then performing thermal treatment at a temperature of 180 to 250° C., the metal paste is formed by mixing metal nanopowder 90 to 95 wt % and an organic solvent 5 to 10 wt %, the metal nanopowder is made of Ag and has an average grain diameter of 0.5 to 20 nm.

5. The metal oxide varistor of claim 3, wherein each of the first metal coating layer and the second metal coating layer comprises:

a disk type metal plate coated on the surface of the metal oxide varistor body or the first metal coating layer on the one side or the other side of the first direction based on the center of the metal oxide varistor body or the first metal coating layer; and a plurality of protruded metal plates extended to an end of an edge of the disk type metal plate, wherein an end of each of the plurality of protruded metal plates on the one side of the second direction is connected to the end of the edge of the disk type metal plate, an end of each of the plurality of protruded metal plates on the other side of the second direction is coated so that the plurality of protruded metal plates is disposed within the surface of the metal oxide varistor body or the first metal coating layer on the one side or the other side of the first direction, and the end of each of the plurality of protruded metal plates on the other side of the second direction ha a curve.

6. The metal oxide varistor of claim 1, wherein:

the ACP comprises multiple coated metal particles and a binder mixed with the multiple coated metal particles, and each of the multiple coated metal particles comprises a metal particle and a metal coating layer coated to surround a surface of the metal particle.

7. The metal oxide varistor of claim 6, wherein:

each of the multiple coated metal particles comprises a metal particle and a metal coating layer coated to surround the metal particle, the metal particle is formed using a mixture of Bi and Sn, and the metal coating layer is formed using Ag or Au and formed to have a low melting point of 130 to 200° C.

8. The metal oxide varistor of claim 1, wherein the fuse plate comprises:

an insulating substrate positioned in the first electrode layer coated on the surface of the metal oxide varistor body on the one side of the first direction;

a via hole pattern formed on the one side of the second direction of the insulating substrate;

a pair of first router patterns respectively formed on surfaces of the insulating substrate on the one side and the other side of the first direction in such a way as to be brought into contact with the via hole pattern on the one side of the second direction of the insulating substrate;

a second router pattern formed on the surface of the insulating substrate on the one side of the first direction in such a way as to be isolated from the first router pattern formed on the surface of the insulating substrate on the one side of the first direction on the other side of the second direction of the insulating substrate; and a fuse pattern formed on the surface of the insulating substrate on the one side of the first direction so that the first router patterns and the second router pattern are electrically conductive, wherein the insulating substrate is positioned on the surface of the metal oxide varistor body on the one side of the first direction in such a way as to be horizontal to the one side of the second direction of the first copper-plated wire, a first router pattern formed on the surface of the insulating substrate on the other side of the first direction among the pair of first router patterns is bonded to the first electrode layer coated on the surface of the metal oxide varistor body on the one side of the first direction by the ACP.

9. The metal oxide varistor of claim 8, wherein:

the first copper-plated wire is connected to a surface of the second router pattern on the one side of the first direction by a solder ball, and the solder ball is formed by mixing two or more of Ag, Cu and Sn.

10. The metal oxide varistor of claim 8, wherein a width length of the fuse pattern is smaller than a width length of the first router pattern and a width length of the second router pattern.

11. The metal oxide varistor of claim 8, wherein:

the via hole pattern, the pair of first router patterns, and the second router pattern of the via hole pattern, the pair of first router patterns, the second router pattern and the fuse pattern are made of Cu or Ag, a square router pattern or a solder ball is used as the fuse pattern, the fuse pattern is formed by mixing Ag, Cu and Sn and melts at a temperature of 220 to 300° C. so that the first router pattern and the second router pattern are open.

* * * * *